US007128146B2

(12) United States Patent
Baugh et al.

(10) Patent No.: US 7,128,146 B2
(45) **Date of Patent: *Oct. 31, 2006**

(54) COMPLIANT SWAGE

(75) Inventors: John L. Baugh, Houston, TX (US); Leopoldo S. Gomez, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 150 days.

This patent is subject to a terminal disclaimer.

(21) Appl. No.: 10/773,010

(22) Filed: Feb. 5, 2004

(65) Prior Publication Data

US 2004/0168796 A1 Sep. 2, 2004

Related U.S. Application Data

(60) Provisional application No. 60/450,899, filed on Feb. 28, 2003.

(51) Int. Cl.
*E21B 23/00* (2006.01)
*E21B 43/10* (2006.01)

(52) U.S. Cl. ..... 166/206; 72/393

(58) Field of Classification Search ..... 166/206; 72/393, 119

See application file for complete search history.

(56) References Cited

U.S. PATENT DOCUMENTS 556,718 A 3/1896 Semmer
1,769,350 A * 7/1930 Langstaff ..... 72/120
2,740,456 A 4/1956 Laval, Jr.
2,877,822 A 3/1959 Buck
3,067,801 A 12/1962 Sortor
3,191,677 A * 6/1965 Kinley ..... 166/277
3,354,969 A 11/1967 Ebeling
3,508,610 A 4/1970 Kisling, III
3,664,416 A 5/1972 Nicholas et al.
3,669,190 A * 6/1972 Sizer et al. ..... 166/387
3,776,307 A 12/1973 Young
3,785,193 A * 1/1974 Kinley et al. ..... 72/393
3,798,955 A * 3/1974 Wimmer et al. ..... 72/393
RE28,449 E 6/1975 Edmond
3,948,321 A 4/1976 Owen et al.
4,095,655 A 6/1978 Still
4,337,634 A * 7/1982 Strudel ..... 72/113
4,502,308 A * 3/1985 Kelly ..... 72/58
4,602,495 A 7/1986 Yarnell
4,789,268 A 12/1988 Yarnell
4,848,964 A 7/1989 Yarnell
5,101,653 A 4/1992 Hermes et al.
5,141,053 A 8/1992 Restarick et al.
5,348,095 A 9/1994 Worrall et al.

(Continued)

FOREIGN PATENT DOCUMENTS

BG 23461658 A 8/2000

(Continued)

*Primary Examiner*—David Bagnell
*Assistant Examiner*—Shane Bomar
(74) *Attorney, Agent, or Firm*—Steve Rosenblatt

(57) ABSTRACT

A compliant swage has the ability to change shape to allow clearance of an obstruction while permitting expansion to go on in other areas removed from the obstruction. A series of segments move with respect to each other longitudinally to change overall size. The segments have an additional degree of freedom to change from a round profile of varying diameter to an oblong, elliptical, or an irregular shape so as to compensate in the portion that encounters an obstruction to let the swage pass while at the same time permitting the intended maximum expansion in other portions where conditions permit such expansion.

26 Claims, 13 Drawing Sheets

U.S. PATENT DOCUMENTS

| | | | | |
|---|---|---|---|---|
| 5,366,012 | A | 11/1994 | Lohbeck | |
| 5,623,991 | A | 4/1997 | Jani | |
| 5,667,011 | A | 9/1997 | Gill et al. | |
| 5,785,120 | A | 7/1998 | Smalley et al. | |
| 5,794,703 | A | 8/1998 | Newman et al. | |
| 5,901,789 | A | 5/1999 | Donnelly et al. | |
| 5,960,895 | A | 10/1999 | Chevallier et al. | |
| 6,012,523 | A | 1/2000 | Campbell et al. | |
| 6,016,681 | A * | 1/2000 | Kenning | 72/393 |
| 6,021,850 | A | 2/2000 | Wood et al. | |
| 6,029,748 | A | 2/2000 | Forsyth et al. | |
| 6,070,671 | A | 6/2000 | Cumming et al. | |
| 6,263,966 | B1 | 7/2001 | Haut et al. | |
| 6,315,040 | B1 | 11/2001 | Donnelly | |
| 6,325,148 | B1 | 12/2001 | Trahan et al. | |
| 6,352,112 | B1 * | 3/2002 | Mills | 166/277 |
| 6,450,261 | B1 | 9/2002 | Baugh | |
| 6,622,789 | B1 * | 9/2003 | Braddick | 166/277 |
| 6,702,030 | B1 * | 3/2004 | Simpson | 166/380 |
| 6,763,893 | B1 * | 7/2004 | Braddick | 166/382 |
| 2001/0020381 | A1 | 9/2001 | Kolbe et al. | |
| 2002/0185274 | A1 | 12/2002 | Simpson et al. | |
| 2003/0155118 | A1 * | 8/2003 | Sonnier et al. | 166/206 |
| 2005/0115719 | A1 * | 6/2005 | Simpson et al. | 166/383 |

FOREIGN PATENT DOCUMENTS

| | | | |
|---|---|---|---|
| EP | 0370591 | A2 | 5/1990 |
| WO | WO 03/069115 | A2 | 8/2003 |

* cited by examiner

COMPLIANT SWAGE

PRIORITY INFORMATION

This application claims the benefit of U.S. Provisional Application No. 60/450,899 on Feb. 28, 2003.

FIELD OF THE INVENTION

The field of the invention is expansion of tubulars and more particularly the use of a compliant swage that can expand the tubular while compensating for tight spots where expansion cannot take place.

BACKGROUND OF THE INVENTION

Tubulars are expanded for a variety of reasons. In the application a patch is expanded to repair cracked casing. In other applications tubulars or liners are expanded to connect to each other or to casing downhole to present a larger cross-sectional area for a segment of the well. In other applications, deformation or a collapse of casing from forces of the surrounding formation needs to be corrected to improve the borehole cross-sectional area in the affected zone.

Swages have been used to accomplish this task. Swages are generally a tapered shape coming to a fixed maximum diameter such that when pushed or pulled through the obstructed area results in making the tubular either resume its initial round dimension or expand the tubular into an even larger round dimension. More recently swages that could change circular dimension were disclosed by the inventors of the present invention in a U.S. provisional application filing on Feb. 11, 2002 having Ser. No. 60/356,061. That design allowed connected segments to move longitudinally with respect to each other to vary the circular maximum diameter of the swage. This ability had the advantage of changing size in the face of an obstruction to avoid sticking the swage or overloading the swage driving apparatus. This device had the capability of reducing to a smaller diameter to allow clearing of an obstruction. Its limitation was that if a tight spot adjacent the outside of only a part of the circumference of the tubular to be expanded was encountered, the swage reduced its diameter symmetrically to clear the obstruction. This resulted in a decrease in cross-sectional area beyond the amount necessary to clear the localized obstruction.

The present invention presents a compliant swage that has enough range of motion among its components to provide sufficient articulation to let the swage go out of round in profile. This permits a part of the swage to reduce in dimension at the localized obstruction while in the remaining regions where there is no such resistance, the expansion can continue as the swage advances. The net result is a larger cross-sectional area can be obtained than with the prior design and the obstruction can still be cleared. These and other advantages of the present invention will become more apparent to those skilled in the art from a review of the description of the preferred embodiment and the claims, which appear below.

SUMMARY OF THE INVENTION

A compliant swage has the ability to change shape to allow clearance of an obstruction while permitting expansion to go on in other areas removed from the obstruction. A series of segments move with respect to each other longitudinally to change overall size. The segments have an additional degree of freedom to change from a round profile of varying diameter to an oblong, elliptical, or an irregular shape so as to compensate in the portion that encounters an obstruction to let the swage pass while at the same time permitting the intended maximum expansion in other portions where conditions permit such expansion.

DETAILED DESCRIPTION OF THE DRAWINGS

FIG. 11 is the view of FIG. 10 in the minimum dimension position during run in;

DETAILED DESCRIPTION OF THE PREFERRED EMBODIMENT

Figure 1:
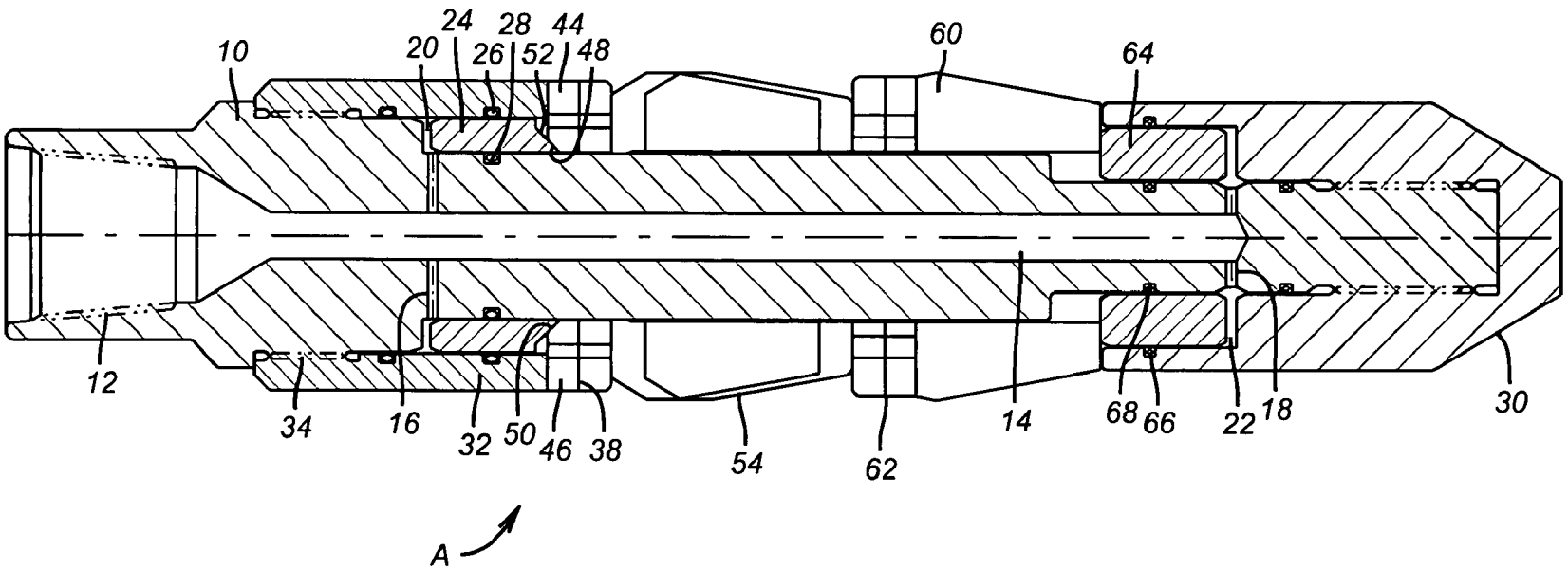
FIG. 1 is a section view of the swage assembly in the run in position.

FIG. 1 shows the preferred embodiment of the swage apparatus A of the present invention. It has a mandrel 10 with thread 12 for connecting tubing or some other driving mechanism (not shown). Passage 14 has lateral exits 16 and 18 to communicate applied pressure to annular cavities 20 and 22 respectively. Rounding piston 24 is sealed by seals 26 and 28 so that pressure in cavity 20 urges rounding piston 24 toward lower end 30 of the apparatus A. Swage anchor 32 is held at thread 34 to mandrel 10. Near its lower end 36 there are a plurality of preferably T-shaped openings 38, although other shapes can be used.

Figure 3:
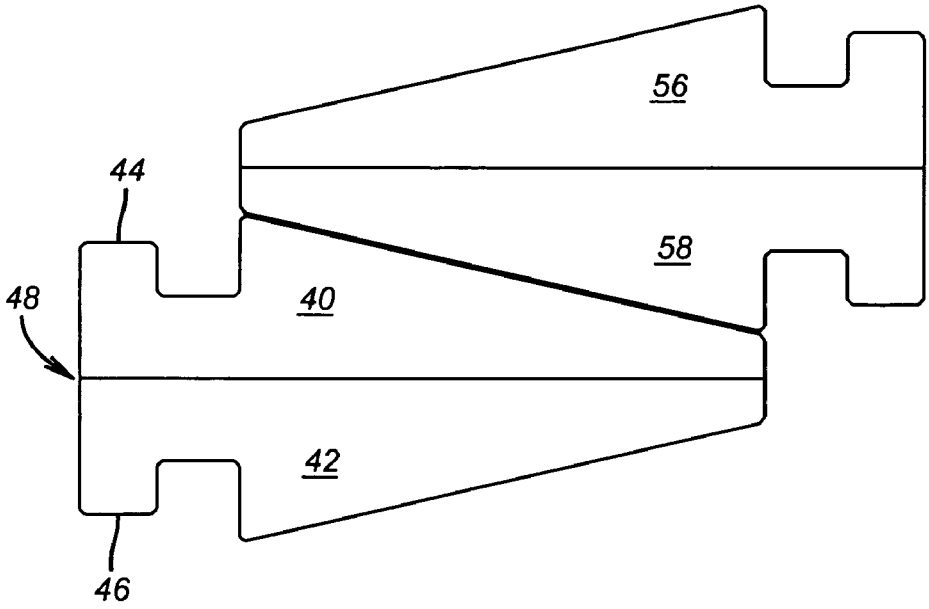
FIG. 3 is a detail of a pair of segments that are upwardly oriented and an adjacent par that is oppositely oriented.
Figure 9:
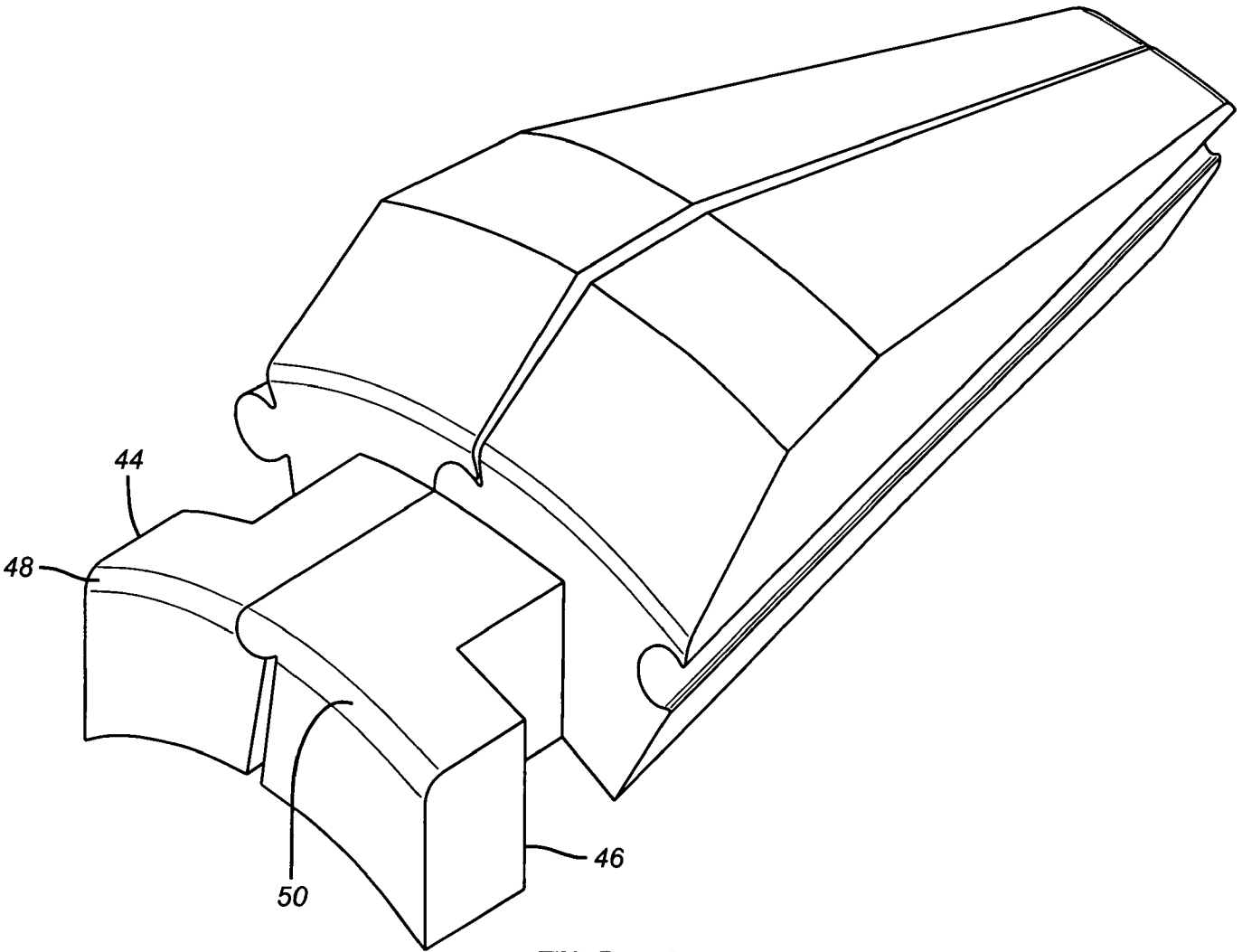
FIG. 9 is the view from the opposite end as compared to FIG. 8.

Referring to FIG. 3 swage segments 40 and 42 have C-shaped upper ends 44 and 46 respectively so that when brought together the adjacent upper ends 44 and 46 take on a T-shape that is designed to fit loosely in T-shaped openings 38 in swage anchor 32. Referring to FIGS. 1 and 9, it can be seen that upper ends 44 and 46 respectively include beveled surfaces 48 and 50 onto which the beveled lower end 52 of rounding piston 24 is brought to bear.

Figure 11:
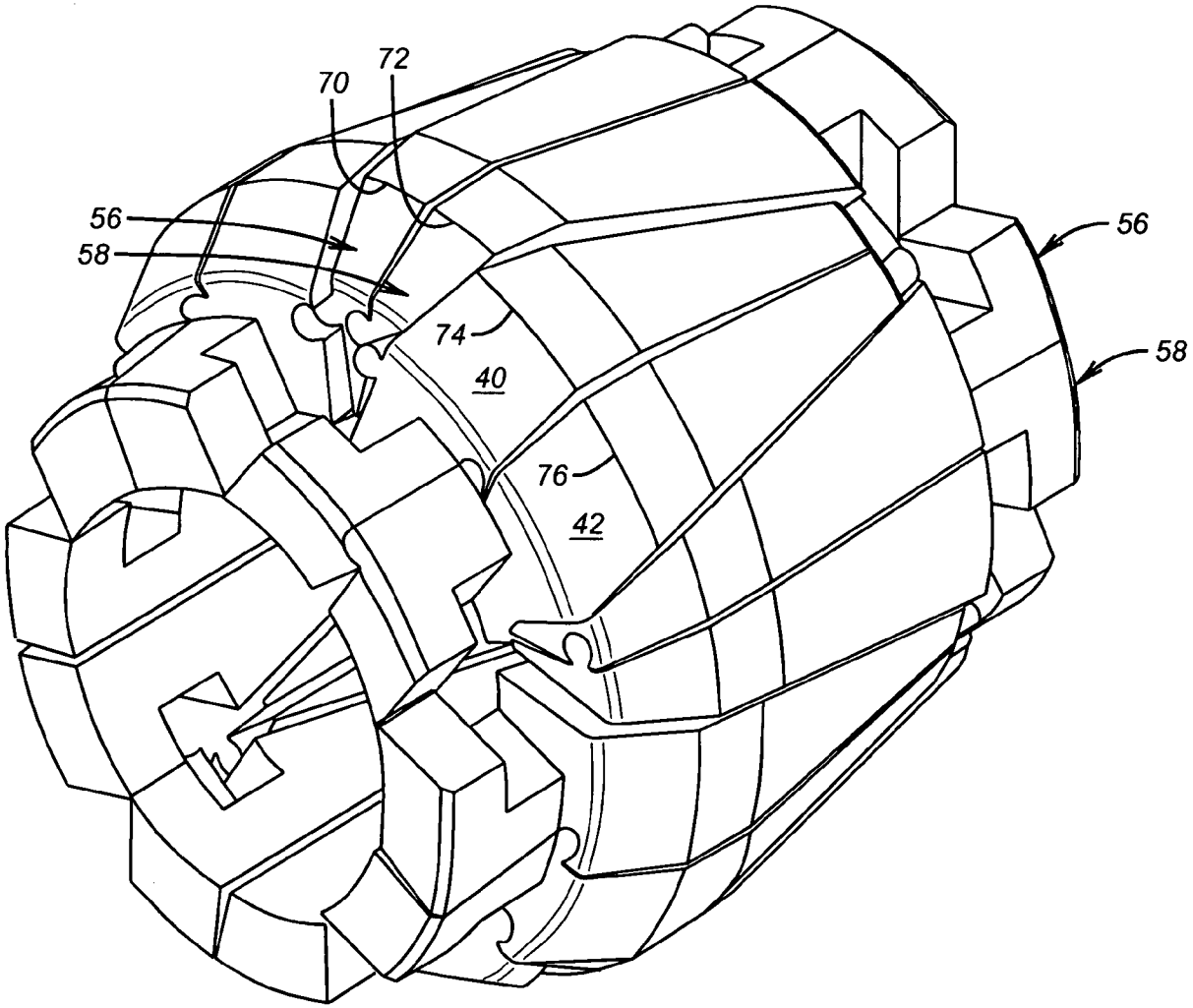
Figure 13:
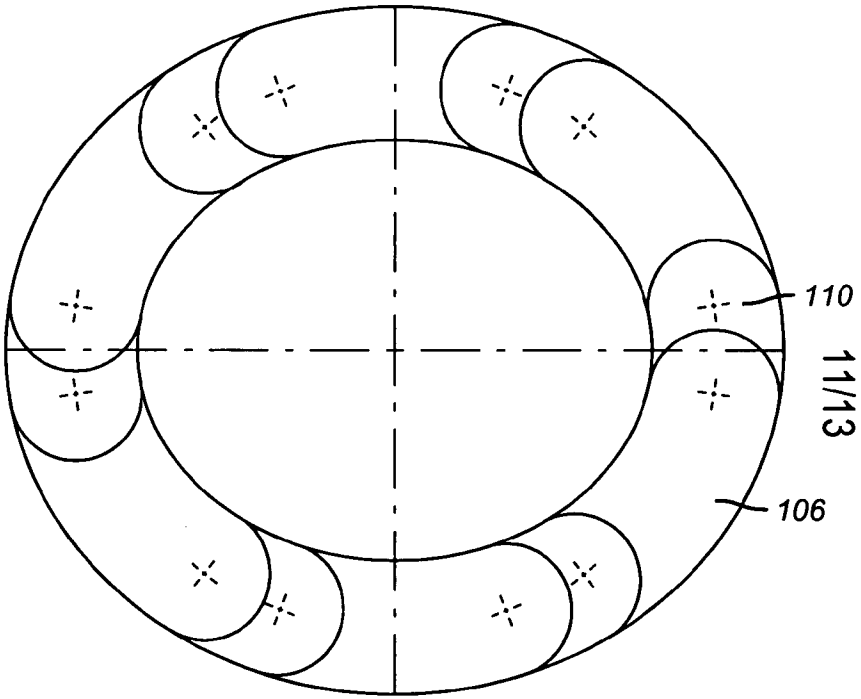
FIG. 13 is the view of FIG. 12 after an obstruction is encountered and the segments have moved to an out of round shape to clear the obstruction.
Figure 12:
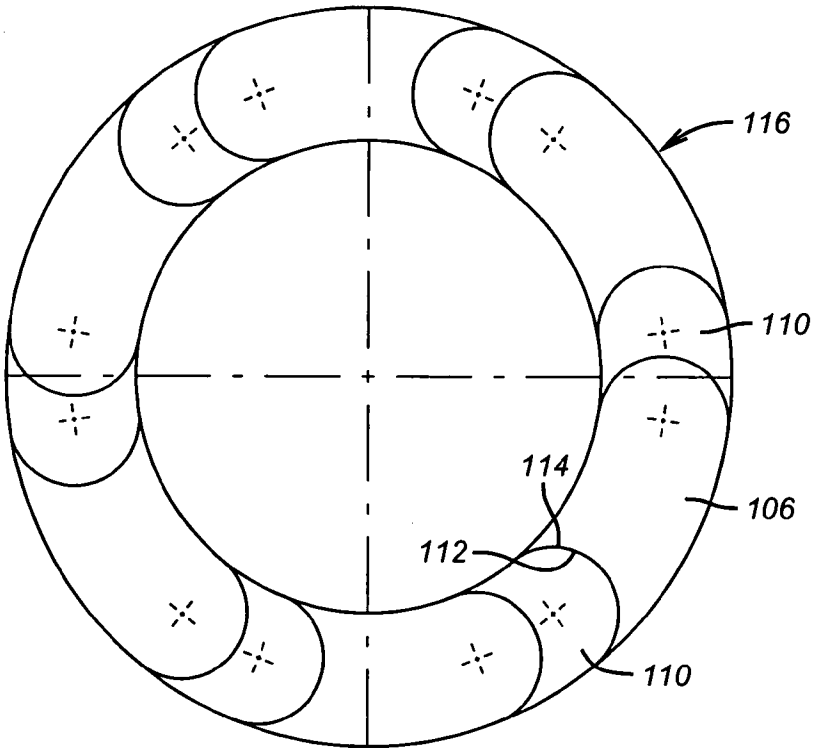
FIG. 12 shows an alternative embodiment where the segments abut in acrcuate contact and the segments are in a round configuration.

The assembly that comprises the compliant swage 54 is partially shown in a flattened view in FIG. 3 and in perspective in FIG. 11, during the run in procedure.

Figure 4:
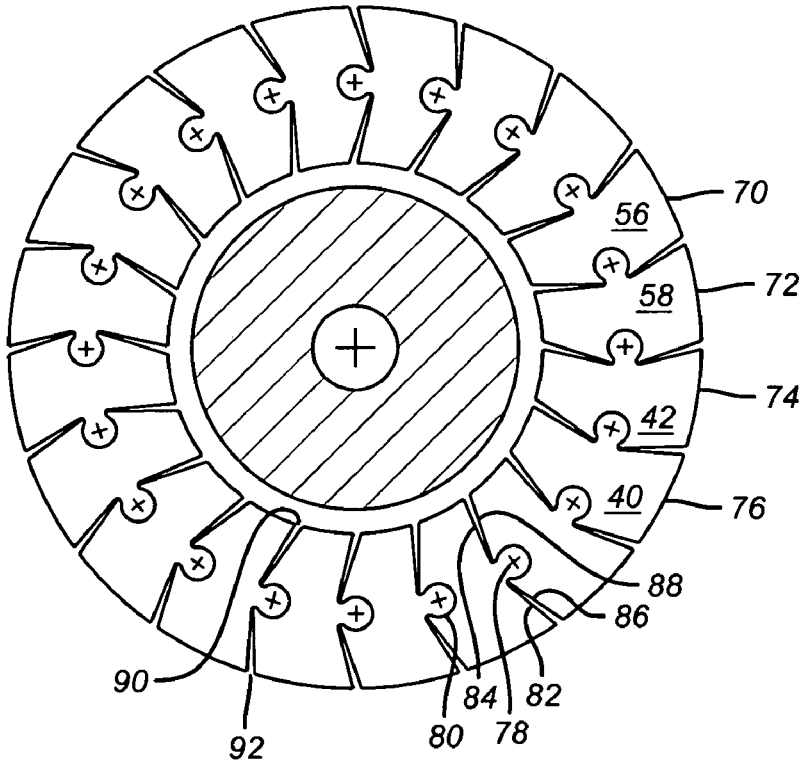
FIG. 4 is a section view through lines 2—2 of FIG. 2.

FIG. 1 illustrates a run in position with preferably no pressure in passage 14. In that case there is no uphole pressure from piston 64 and segment pairs 56 and 58 are in their lowermost position so that the compliant swage assembly is at its minimum dimension. This position is best seen in the perspective view of FIG. 11. Ridgelines 70 and 72 on segment pairs 56 and 58 are longitudinally offset from ridgelines 74 and 76 on segment pairs 40 and 42. This should be compared with the swaging position shown in FIG. 10. In this view, fluid pressure is applied in passage 14 pushing piston 64 uphole and with it segment pairs 56 and 58. The ridgelines 70, 72, 74 and 76 align in a circular configuration, as shown in FIG. 4. The circular configuration is promoted by the wedging action from beveled lower end 52 of rounding piston 24 forcing the segment pairs 40 and 42 into such a shape. Since all the segment pairs are interconnected, as will be described, the compliant swage assembly 54 as a whole assumes a circular shape for the purpose of swaging at the pre-designated maximum dimension, illustrated in the perspective view of FIG. 10.

FIG. 1 illustrates a run in position with preferably no pressure in passage 14. In that case there is no uphole pressure from piston 64 and segment pairs 56 and 58 are in their lowermost position so that the compliant swage assembly is at its minimum dimension. This position is best seen in the perspective view of FIG. 11. Ridgelines 70 and 72 on segment pairs 56 and 58 are longitudinally offset from ridgelines 74 and 76 on segment pairs 40 and 42. This should be compared with the swaging position shown in FIG. 10. In this view, fluid pressure is applied in passage 14 pushing piston 64 uphole and with it segment pairs 56 and 58. The ridgelines 70, 72, 74 and 76 align in a circular configuration, as shown in FIG. 4. The circular configuration is promoted by the wedging action from beveled lower end 52 of rounding piston 24 forcing the segment pairs 40 and 42 into such a shape. Since all the segment pairs are interconnected, as will be described, the compliant swage assembly 54 as a whole assumes a circular shape for the purpose of swaging at the pre-designated maximum dimension, illustrated in the perspective view of FIG. 10.

Figure 7:
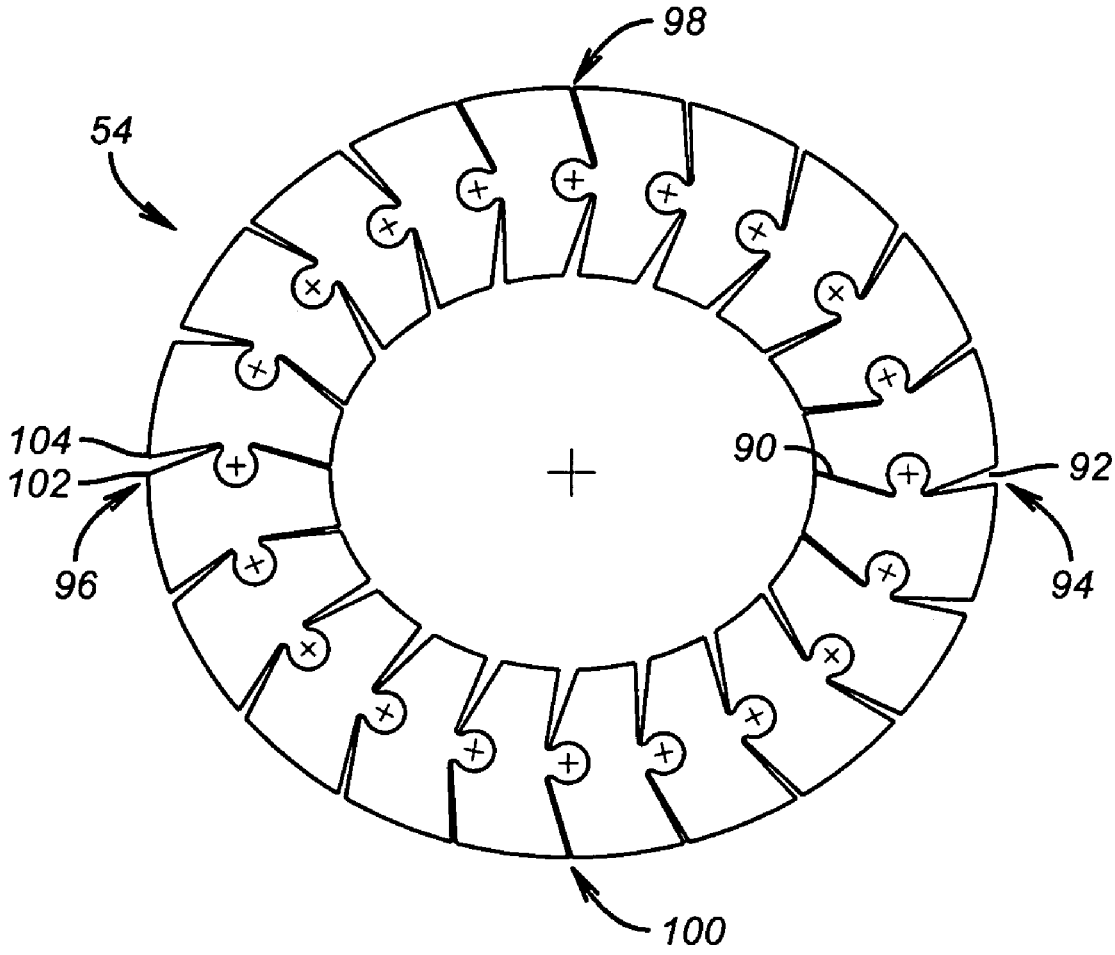
FIG. 7 is a section view along lines 7—7 of FIG. 2 when an obstruction is encountered.
Figure 8:
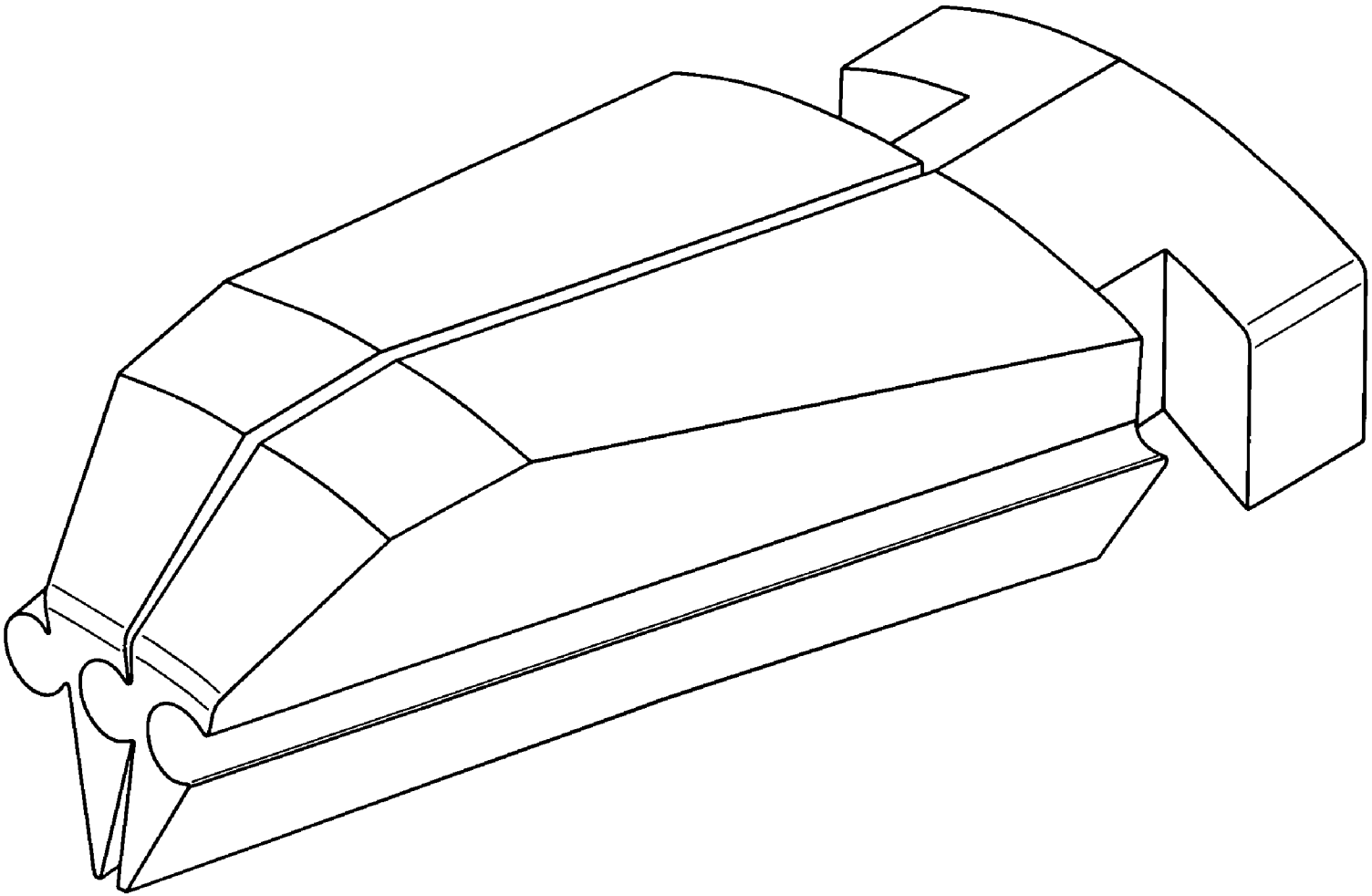
FIG. 8 is a perspective view of two adjacent segments showing how they connect to each other in a tongue and groove manner.

FIG. 4 shows a mode of interconnection. Every segment preferably has a tongue 78 on one edge and a groove 80 on the opposite edge. On either side of each tongue 78 are surfaces 82 and 84. On either side of groove 80 are surfaces 86 and 88. Surfaces 84 and 88 define a gap 90 between them and surfaces 82 and 86 define a gap 92 between them. These gaps allow articulation between adjacent segments so that the circular shape shown in FIG. 4 for swaging at maximum dimension uniformly until an exterior obstruction is met can change into an out of round shape shown in FIG. 7. To assume the shape of FIG. 7, some of the gaps 90 have closed completely while gaps 92 between the same two segments have opened fully in zones 94 and 96. At the same time, in zones 98 and 100 the movement is opposite. The compliant swage assembly 54 has now taken a somewhat oval shape in departing from the optimal round shape. It should be noted that depending on the allowable dimensions of gaps 90 and 92 a greater or lesser amount of articulation is possible. There are several limiting factors on the amount of articulation provided. One is the strength of the connection between a tongue 78 and an adjacent groove 80. Another, is the desire to keep the outer gaps 92 to a minimum dimension for the reason that large gaps can allow opposed edges such as 102 and 104 to concentrate stress in the expanded tubular by putting line scores in it. Depending on the amount of expansion and subsequent service, such scoring and stress concentration can result in premature cracking of the expanded tubular. FIGS. 4 and 7 illustrate that the articulated swage assembly 54 is held together at maximum dimension of FIG. 4 or in an out of round articulated shape to allow the expansion of the tubular to the maximum dimension where no resistance is encountered while allowing inward articulation to clear the obstruction in the zone where it is encountered. The net result is a larger expanded cross-section of the tubular where the obstruction occurs than would have been possible with the prior design that simply transitioned from a larger circle to a sufficiently smaller circle to clear the exterior obstruction. Another limiting issue on the amount of articulation is the tubular being expanded. There are limits that the tubular can endure in differential expansion between its various zones to clear an obstruction. The design of FIGS. 4 and 7 represent one solution to the need to hold the segments together while permitting articulation to achieve a desired swaging shape change. Clearly the tongue and groove connections hold the assembly of segments together as they are moved from the run in position of FIG. 1 to the onset of swaging position shown in FIG. 2 with pressure applied to passage 14.

Figure 2:
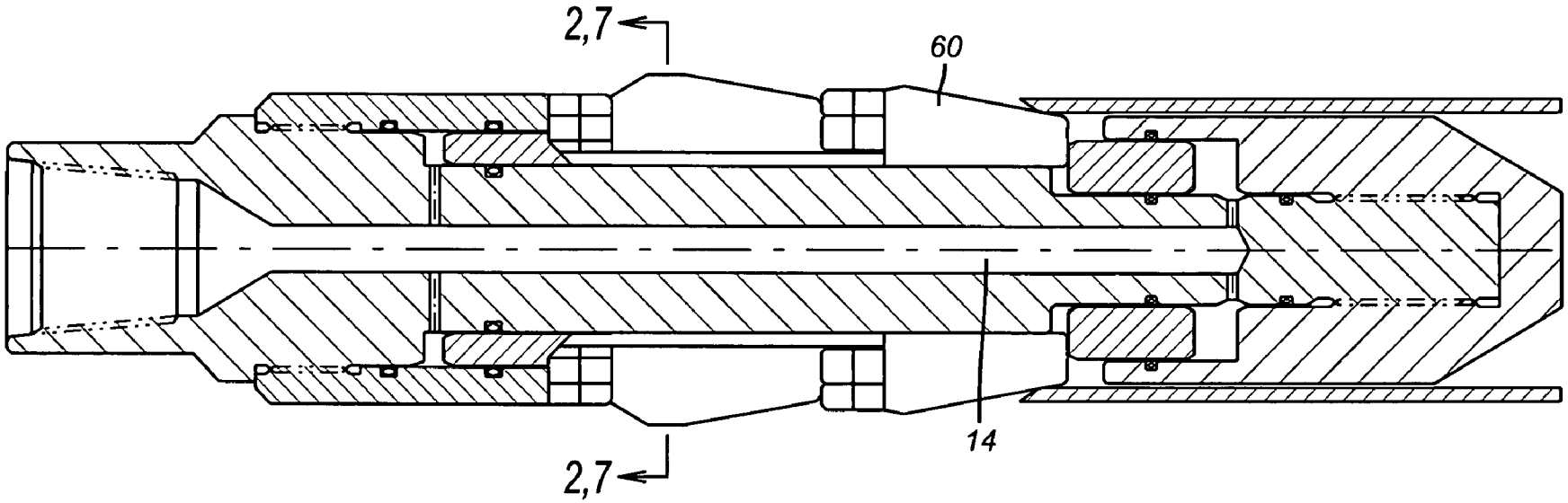
FIG. 2 is the view of FIG. 1 in the beginning to swage position.
Figure 14:
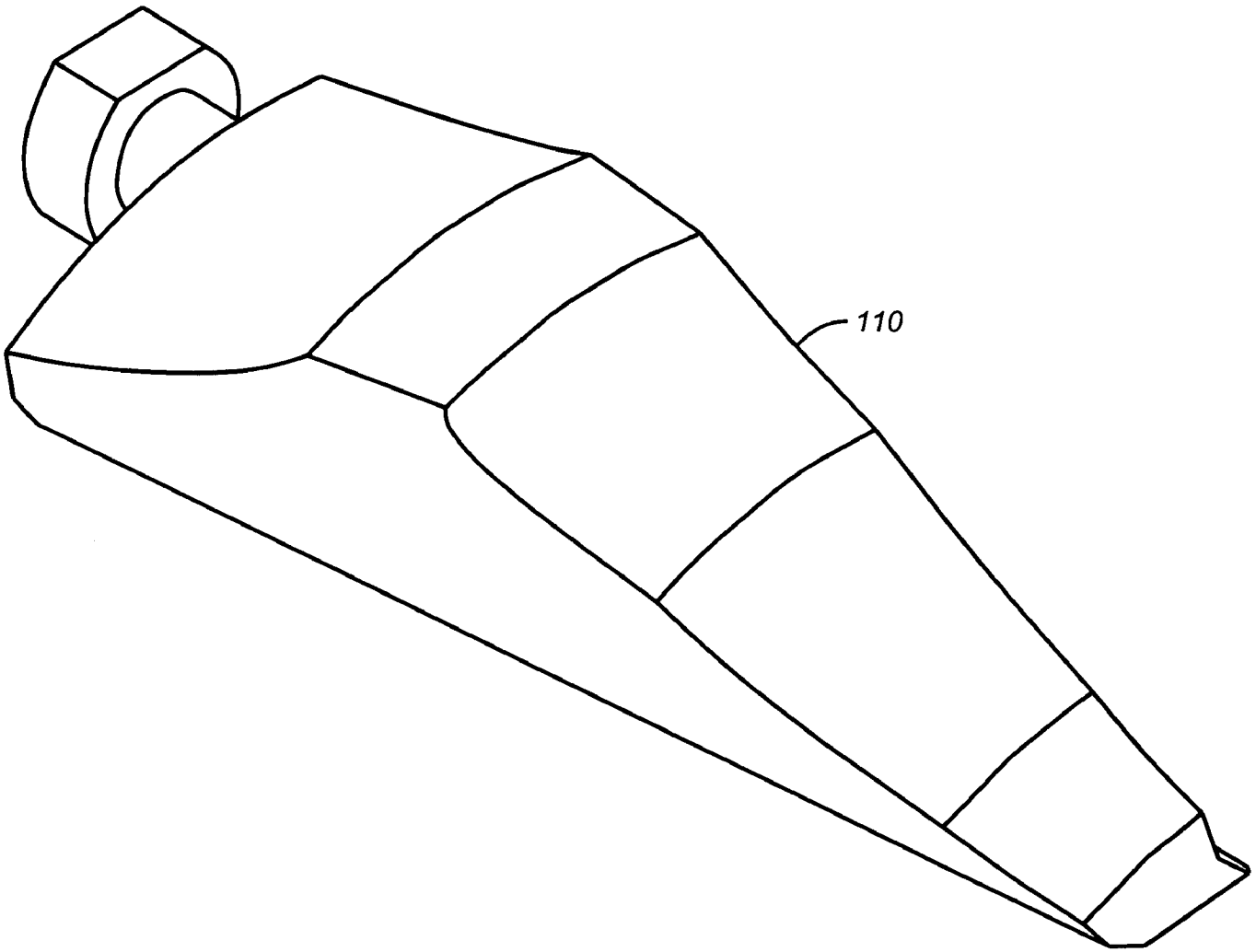
FIG. 14 is an alternate embodiment to FIG. 3 where a single segment is connected at the T-shaped connection instead of a par of segments.
Figure 15:
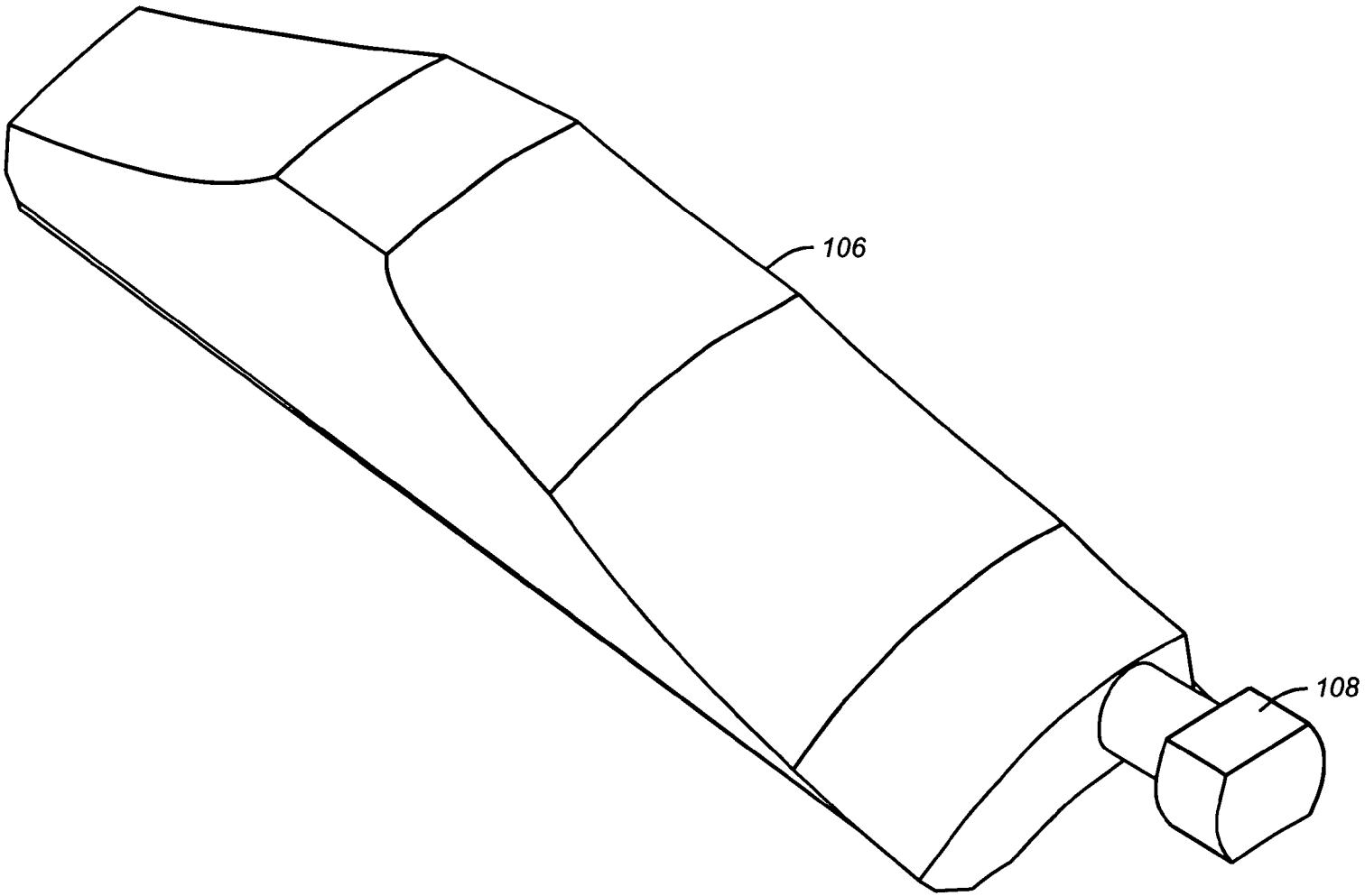
FIG. 15 is the mating segment to FIG. 14 in the alternative embodiment to FIG. 12 where the segments have arcuate edge contact and a single segment rather than a pair is connected at a T-shaped connection.

FIGS. 12, 13, 14 and 15 show an alternate design. The segments are no longer in pairs as shown in FIG. 3; rather a segment 110 has a T-shaped connection 108 to be inserted into an opening 38 in swage anchor 32. Abutting on either side is a segment 106 that is oppositely oriented and connected to swage 60. The interface between the segments 106 and 110 is no longer a tongue and groove. Rather, each interface is a pair of arcuate surfaces 112 and 114 to allow the assembly articulate from the originally round shape shown in FIG. 12 to an out of round shape shown in FIG. 13 to clear an obstruction external to the tubular being expanded. The end connections of the segments 106 and 110 respectively to swage anchor 32 and swage 60 are made deliberately loose to permit relative movement between surfaces 112 and 114 to permit the articulation to the desired shape to avoid the obstruction exterior to the tubular being swaged. One notable difference is that there are no gaps in the periphery 116 where the swaging action is taking place regardless of the configuration of the segments in the round or out of round positions shown in FIGS. 12 and 13. Those skilled in the art will appreciate that band springs or equivalents can be used to limit the outward movement of the segments 106 and 110 as the interacting arcuate surfaces 112 and 114 do not provide such an outward travel stop. Even using the interface of FIGS. 12 and 13, the minimum and maximum dimensions of the compliant swage assembly 54 shown in FIGS. 1 and 2 are still achieved by relative longitudinal movement between the segments oriented uphole and those that are oppositely oriented. The total number of segments is fewer in the FIGS. 12, 13, 14 and 15 version but greater numbers of segments can also be used. For example, segment pairs as shown in FIG. 3 can be used with the arcuate edge interfaces, within the scope of the invention. Conversely, as shown in FIG. 14 the segment pairs of FIG. 3 can be cut in half using larger segments that still employ an edge connection using a tongue and groove or another mechanically equivalent arrangement.

Figure 5:
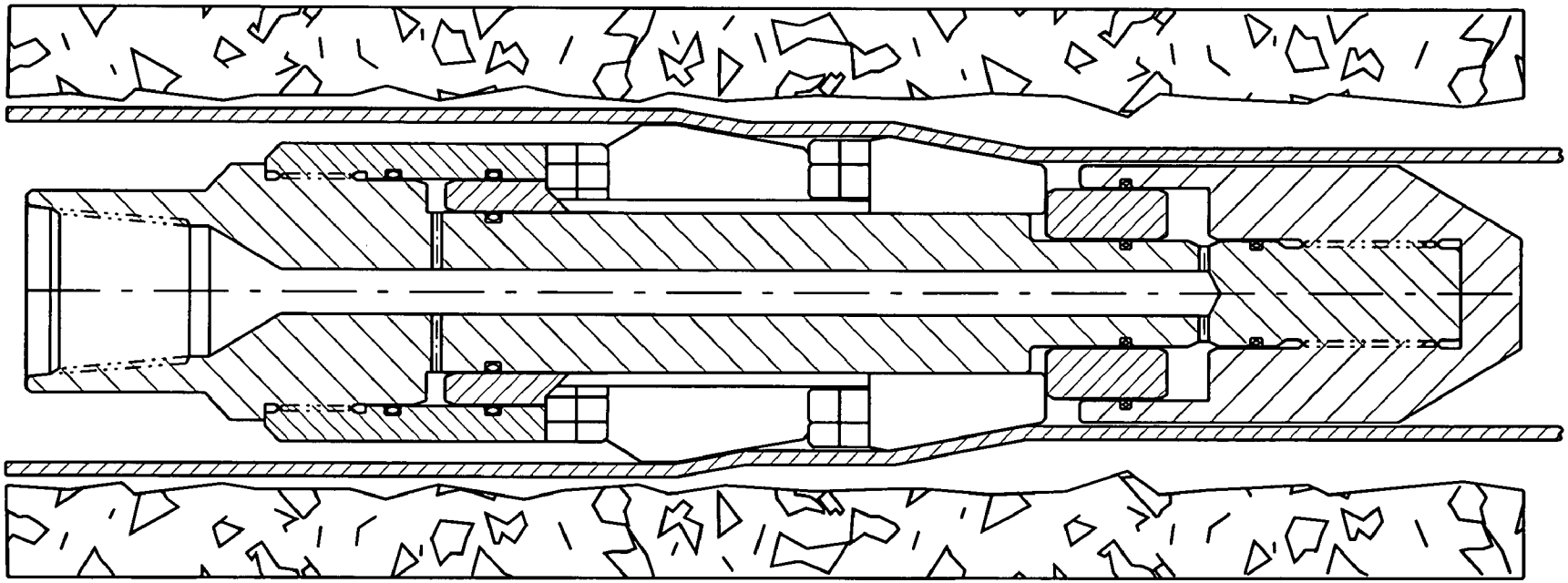
FIG. 5 is the view of FIG. 2 showing the expansion proceeding prior to encountering an obstruction.
Figure 6:
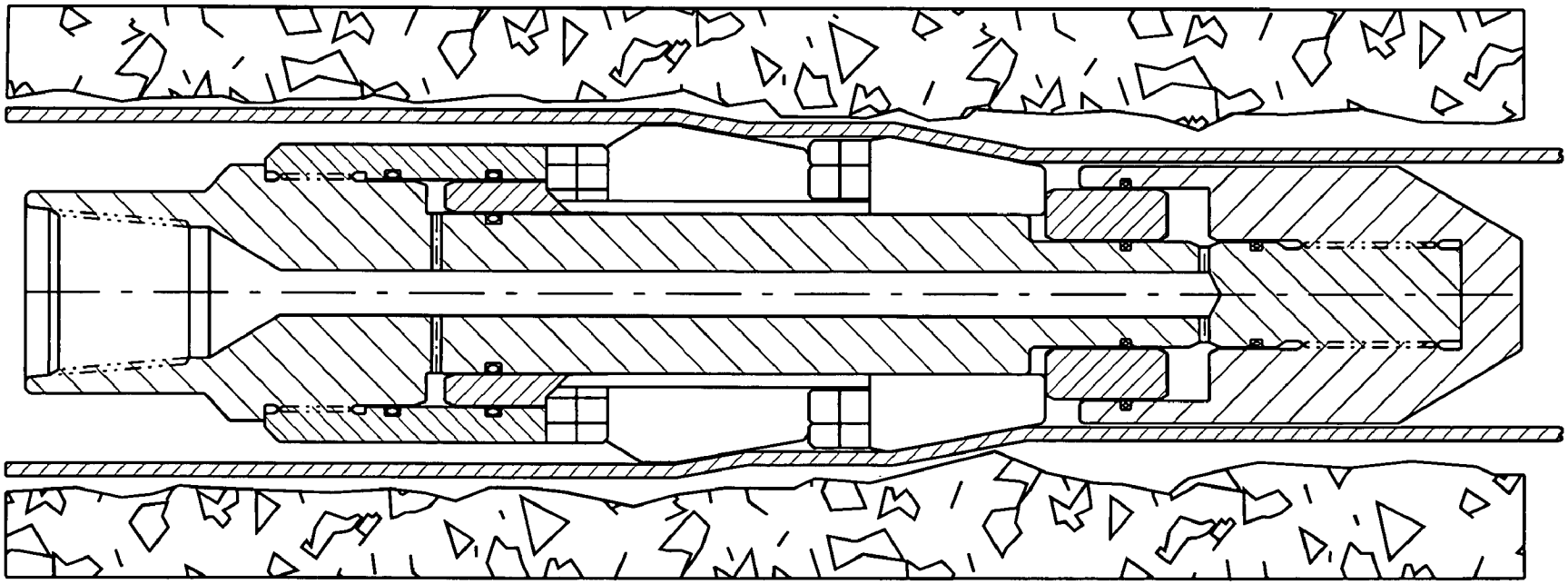
FIG. 6 is the view of FIG. 5 just as an obstruction is about to be encountered.
Figure 10:
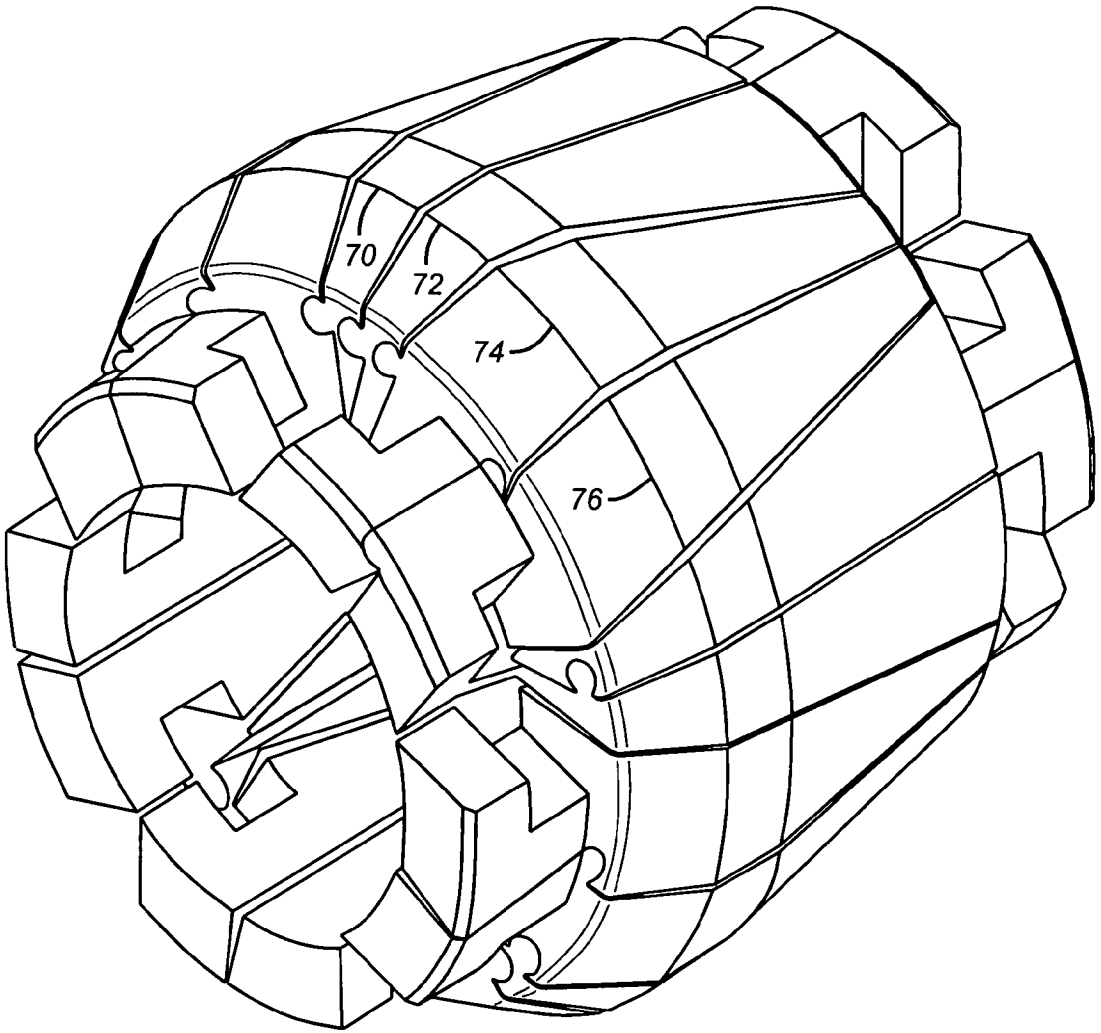
FIG. 10 is a perspective view of the assembled segments in the maximum dimension position.

The method of using any of the above-described configurations can be seen by initially looking at FIG. 1 for the run in position. At this time there is no pressure applied in passage 14 and the piston 64 and with it the swage 60 and the connected segments, such as 56 and 58 are in their lowermost position, simply due to their own weight. The compliant swage assembly 54 is in the FIG. 11 position with ridgelines 70 and 72 out of alignment with ridgelines 74 and 76. The compliant swage 54 is therefore in its minimum diameter position. Those skilled in the art will realize that the expansion can occur along the aligned ridge lines, as shown in FIG. 10 or along a surface as opposed to a line contact shown in FIG. 10. The FIG. 10 position is achieved by putting pressure from the surface in passage 14 to push swage 60 uphole and to force rounding piston 24 down on beveled surfaces 48 and 50. This latter action puts the compliant swage in a round configuration illustrated in FIG. 4 for the start of swaging. This position of the apparatus A is shown in FIG. 2. If used, the fixed swage 60 enters the tubing to be expanded first. If it will not pass, the apparatus A must be retrieved. Once it passes, the compliant swage assembly 54, now in the FIG. 10 position due to pressure in passage 14, makes contact with the tubular to be expanded. The segments remain in the round position shown in FIG. 4 as long as there is no external obstruction to expansion of the tubular, as is shown in FIG. 5. When a restriction or obstruction is reached, as shown in FIG. 6, the compliant swage assembly 54 will articulate to change dimension to try to pass the obstruction by getting smaller in the zone where the obstruction is found and swaging as large as possible where the obstruction is not present. This articulation occurs with pressure continuing to be applied in passage 14. If the tongue 78 of one segment is engaged to a groove 80 in an adjacent segment, relative rotation about an axis defined by the tongue in groove connection permits the articulation as the size of gaps 90 and 92 between the affected segment pairs begins to change. In the abutting arcuate surfaces design shown in two positions in FIGS. 12 and 13, relative rotations along the arcuate surfaces 112 and 114 results in the desired articulation while presenting a continuous and uninterrupted surface or edge 116 for continued swaging despite an obstruction. In the end, if the compliant swage assembly 54 can actually pass through the obstruction, the resulting cross-sectional area of the expanded tubular is larger than it otherwise would have been if its circular cross-section had been maintained but its dimension reduced to the point where the obstruction could have been cleared. Clearly the larger the number of segments in the compliant swage assembly 54 the better its ability to articulate. However, the maximum round diameter of the compliant swage assembly 54 and the required strength of the segments to actually do the swaging required will have an effect on the number of segments to be employed.

Those skilled in the art will appreciate that surfaces 112 and 114 do not have to be singular arcs or have the same radius. They can be a series of surfaces and have different curvatures. The illustrated embodiment is illustrative of the inventive concept of articulation in combination with nearly continuous edge or surface contact. The alternative articulation concept is also illustrative of the ability to articulate but allowing some gaps in the swaging line or surface contact to accomplish the desired articulation.

The foregoing disclosure and description of the invention are illustrative and explanatory thereof, and various changes in the size, shape and materials, as well as in the details of the illustrated construction, may be made without departing from the spirit of the invention.

We claim:

1. An adjustable swage for use on a downhole tubular, comprising:

a rounded body mounted to a mandrel wherein said body is movable, during expansion downhole, into a plurality of positions to create a variety of profiles effective for a full 360° about said mandrel.

2. The swage of claim 1, wherein:

said profiles comprise circular and non-circular shapes.

3. An adjustable swage for use on a downhole tubular, comprising:

a rounded body mounted to a mandrel wherein said body is movable into a plurality of positions to create a variety of profiles effective for a full 360° about said mandrel;

said round body comprises a plurality of articulated components that allow the profile to be reduced in response to a portion of the tubular that resists expansion while permitting a larger profile dimension in other parts of the tubular where there is no such resistance.

4. The swage of claim 3, wherein:

said articulated components present no gaps along said profile.

5. The swage of claim 3, wherein:

said articulated components present gaps along said profile.

6. The swage of claim 3, wherein:

said articulated components move relatively to each other to change the dimension on at least a portion of said profile.

7. The swage of claim 6, wherein:

said articulated components rotate on adjacent edge arcuate surfaces.

8. The swage of claim 7, further comprising:

a retention device mounted around said articulated components to hold them together.

9. The swage of claim 6, wherein:

said articulated components are retained to each other within said profile.

10. The swage of claim 9, wherein:

pairs of said articulated components are retained to each other by a tongue and groove connection.

11. The swage of claim 10, wherein:

said tongue and grove connection has a longitudinal axis whereupon adjacent articulated components that are secured by said tongue and groove connection can rotate with respect to each other about said longitudinal axis of said tongue and groove joint.

12. The swage of claim 11, wherein:

gaps along said profile close to reduce its dimension to clear an obstruction while gaps widen to increase said profile in other locations to achieve, in other zones where there is insufficient resistance, the desired expansion of the tubular.

13. An adjustable swage for use on a downhole tubular, comprising:

a rounded body mounted to a mandrel wherein said body is movable, during expansion, into a plurality of positions to create a variety of profiles effective for a full 360° about said mandrel;

said body is formed of a plurality of abutting segments movable with respect to each other.

14. The swage of claim 13, wherein:

said segments each comprise a high location and at least some of said segments are movable to selectively align said high locations to obtain a maximum diameter or to offset them to attain a minimum diameter.

15. The swage of claim 13, wherein:

said mandrel has a longitudinal axis and said segments slide relatively to each other in the direction of said longitudinal axis.

16. The swage of claim 15, wherein:

said segments are retained to each other while moving relatively to each other in a longitudinal direction.

17. An adjustable swage for use on a downhole tubular, comprising:

a rounded body mounted to a mandrel wherein said body is movable into a plurality of positions to create a variety of profiles effective for a full 360° about said mandrel;

said body is formed of a plurality of abutting segments movable with respect to each other;

said mandrel has a longitudinal axis and said segments slide relatively to each other in the direction of said longitudinal axis;

said segments are retained to each other while moving relatively to each other in a longitudinal direction;

said segments are retained to each other at their abutting edges by a tongue and groove connection.

18. An adjustable swage for use on a downhole tubular, comprising:

a rounded body mounted to a mandrel wherein said body is movable into a plurality of positions to create a variety of profiles effective for a full 360° about said mandrel;

said body is formed of a plurality of abutting segments movable with respect to each other;

said segments are wedge shaped having a narrow end and a wide end and are arranged in an alternating pattern where the narrow end of one segment, in a first orientation, is adjacent the wide end of a neighboring segment, in a second orientation, on either side.

19. The swage of claim 18, wherein:

said segments in one of said first and second orientations is selectively held fixed and said segments in the other of said first and second orientations is movable.

20. The swage of claim 19, wherein:

said segments each comprise a high location and at least some of said segments are movable to selectively align said high locations to obtain a maximum diameter or to offset them to attain a minimum diameter.

21. The swage of claim 20, wherein:

said movable segments are biased in the direction to obtain said maximum diameter.

22. The swage of claim 21, wherein:

said movable segments are driven as well as biased in the direction to obtain said maximum diameter.

23. The swage of claim 22, wherein:

said movable segments are driven by a piston driven by fluid pressure applied to it through said mandrel; and said bias is provided by a stack of Belleville washers.

24. The swage of claim 20, wherein:

said mandrel has a longitudinal axis and said segments slide relatively to each other in the direction of said longitudinal axis.

25. The swage of claim 24, wherein:

said segments are retained to each other while moving relatively to each other in a longitudinal direction.

26. The swage of claim 25, wherein:

said segments are retained to each other at their abutting edges by a tongue and groove connection.

* * * * *